US010329749B2

(12) United States Patent
Kacik et al.

(10) Patent No.: US 10,329,749 B2
(45) **Date of Patent: *Jun. 25, 2019**

(54) PLUMBING FIXTURE FITTING

(71) Applicant: Moen Incorporated, North Olmsed, OH (US)

(72) Inventors: Mark S. Kacik, Lakewood, OH (US); Dale A. Pulver, Oberlin, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/047,095

(22) Filed: Jul. 27, 2018

(65) Prior Publication Data

US 2018/0334787 A1 Nov. 22, 2018

Related U.S. Application Data

(63) Continuation of application No. 15/606,792, filed on May 26, 2017, now Pat. No. 10,036,145, which is a continuation of application No. 14/491,494, filed on Sep. 19, 2014, now Pat. No. 9,663,925.

(60) Provisional application No. 61/880,829, filed on Sep. 20, 2013.

(51) Int. Cl.
*E03C 1/04* (2006.01)
*E03C 1/08* (2006.01)

(52) U.S. Cl.
CPC ..... *E03C 1/0404* (2013.01); *E03C 1/08* (2013.01); *E03C 2001/0415* (2013.01)

(58) Field of Classification Search
CPC ..... E03C 13/00
USPC ..... 4/300–442, 619–660
See application file for complete search history.

(56) References Cited

U.S. PATENT DOCUMENTS

| | | | |
|---|---|---|---|
| 4,055,306 | A | 10/1977 | Hruby, Jr. |
| 4,135,670 | A | 1/1979 | Sugimoto |
| 4,813,611 | A | 3/1989 | Fontana |
| 5,579,999 | A | 12/1996 | Seiner et al. |
| 5,744,033 | A | 4/1998 | Bertrand et al. |
| 5,788,157 | A | 8/1998 | Kress |
| 5,931,392 | A | 8/1999 | Adams |
| 6,290,147 | B1 | 9/2001 | Bertrand et al. |

(Continued)

FOREIGN PATENT DOCUMENTS

| | | | |
|---|---|---|---|
| CN | 1953810 | A | 4/2007 |
| CN | 101080278 | A | 11/2007 |
| CN | 201067715 | Y | 6/2008 |

OTHER PUBLICATIONS

International Search Report for International App. No. PCT/US2014/056609 dated Feb. 25, 2015 (5 pages).

(Continued)

*Primary Examiner* — Lori L Baker

(74) *Attorney, Agent, or Firm* — Calfee, Halter & Griswold LLP

(57) ABSTRACT

The present invention provides a plumbing fixture fitting having a spray mode with improved spray performance. The fitting includes a spray face. The spray face includes nozzles. The nozzles are operable to deliver water from the spray face in the form of a spray. The spray includes streamlets. An average unbroken length of the streamlets is greater than approximately two inches at a flow rate of approximately thirty-seven thousandths gallons per minute.

10 Claims, 17 Drawing Sheets

(56) References Cited

U.S. PATENT DOCUMENTS

| | | | |
|---|---|---|---|
| 6,851,632 | B2 | 2/2005 | Ferrazza et al. |
| 6,899,292 | B2 | 5/2005 | Titinet |
| 7,364,097 | B2 | 4/2008 | Okuma |
| 7,850,098 | B2 | 12/2010 | Vogel et al. |
| 10,036,145 | B2 * | 7/2018 | Kacik ..... E03C 1/0404 |
| 2003/0173423 | A1 | 9/2003 | Haenlein et al. |
| 2010/0276519 | A1 | 11/2010 | Lee |
| 2011/0088784 | A1 | 4/2011 | Meehan et al. |
| 2013/0193237 | A1 | 8/2013 | Erickson |

OTHER PUBLICATIONS

Written Opinion of the International Searching Authority for International App. No. PCT/US2014/056609 dated Feb. 25, 2015 (6 pages).

Wand Spray Force, Velocity, Splash, and Specific Flow Rate Graphs, the graphs in the cited document were obtained from tests conducted on wands that were publicly available prior to Sep. 20, 2013, these tests were conducted by Moen Incorporated, the applicant and assignee of the application, the graphs in the cited document have not been published (4 pages).

McMaster-Carr High-Pressure Spray Nozzle Product No. 3234K1* with spray angle of 0 degrees, McMaster-Carr Catalog, p. 2089, the nozzle and the catalog were publicly available prior to Sep. 20, 2013, the catalog page was obtained from the Internet, the catalog page is currently available at www.mcmaster.com/#catalog/121/2089/=zn0rrp (1 page).

McMaster-Carr High-Pressure Spray Nozzle Product No. 3234K1* with spray angle of 0 degrees, photograph of cross-sectioned nozzle, the nozzle was publicly available prior to Sep. 20, 2013, the nozzle was cross-sectioned and the photograph was taken by Moen Incorporated, the applicant and assignee of the application, the photograph has not been published (1 page).

First Office Action issued by the State Intellectual Property Office of the People's Republic of China for Chinese App. 201410783872.X dated Oct. 9, 2017 (23 pages).

* cited by examiner

PLUMBING FIXTURE FITTING

CROSS-REFERENCE TO RELATED APPLICATIONS

This application is a continuation application of U.S. Non-Provisional application Ser. No. 15/606,792, filed May 26, 2017, the entire disclosure of which is hereby incorporated by reference, which is a continuation application of U.S. Non-Provisional application Ser. No. 14/491,494, filed Sep. 19, 2014, the entire disclosure of which is hereby incorporated by reference, which claims the benefit of U.S. Provisional Application No. 61/880,829, filed Sep. 20, 2013, the entire disclosure of which is hereby incorporated by reference.

FIELD

The present invention relates generally to a plumbing fixture fitting, and, more particularly, to a plumbing fixture fitting that provides a spray mode with improved spray performance.

BACKGROUND

Plumbing fixture fittings that provide a spray mode are well known. Such plumbing fixture fittings are used in residential and commercial applications, such as in kitchens, laundry rooms, utility rooms, and various other locations. In recent years, legislation has been passed that limits the flow rate from plumbing fixture fittings in certain applications. Limiting the flow rate from plumbing fixture fittings can degrade the spray performance of the plumbing fixture fittings. However, users of plumbing fixture fittings still expect the same spray performance.

Difficulties can be encountered in designing plumbing fixture fittings with limited flow rates while maintaining the spray performance.

SUMMARY

The present invention provides a plumbing fixture fitting having a spray mode with improved spray performance.

In an exemplary embodiment, a faucet comprises a hub and a spout. The hub is operable to connect to a mounting surface. The spout includes a receptor and a wand. The receptor is operable to connect to the hub. The wand is operable to mount in the receptor. The wand is operable to pull away from the receptor. The wand includes a shell, a waterway, a diverter valve, and a spray face. The shell is operable to pull away from the receptor. The waterway is separately formed from the shell. The waterway is operable to be substantially disposed in the shell. The waterway includes an inlet region and an outlet region. The inlet region includes an inlet passage. The outlet region includes a first outlet passage and a second outlet passage. The inlet region is operable to connect to a water hose. The waterway includes a first conduit, a second conduit, and a third conduit disposed between the inlet passage and the first outlet passage and the second outlet passage. The waterway includes a diverter valve chamber. The diverter valve chamber is disposed between the first conduit and the second conduit and between the first conduit and the third conduit. The diverter valve is operable to be received in the diverter valve chamber. The diverter valve is operable to divert fluid flow between the first conduit and the second conduit and between the first conduit and the third conduit. The spray face is operable to connect to the outlet region of the waterway. The spray face includes an opening and a plurality of nozzles. The opening is operable to fluidly communicate with the second conduit and the first outlet passage and deliver water from the spray face in the form of a stream. The nozzles are operable to fluidly communicate with the third conduit and the second outlet passage and deliver water from the spray face in the form of a spray. The spray includes a plurality of streamlets. An average unbroken length of the streamlets is greater than approximately two inches at a flow rate of approximately thirty-seven thousandths gallons per minute.

BRIEF DESCRIPTION OF THE DRAWINGS

-FIG. 2A is an assembled perspective view, and FIG. 2B is an exploded perspective view;

-FIG. 3A is a perspective view, FIG. 3B is a side elevational view, FIG. 3C is a bottom plan view, FIG. 3D is a cross-sectional view taken along the line 3D-3D in FIG. 3C, and FIG. 3E is a partial cross-sectional view taken along the line 3D-3D in FIG. 3C;

-FIG. 4A is a perspective view, FIG. 4B is a side elevational view, FIG. 4C is a bottom plan view, and FIG. 4D is a cross-sectional view taken along the line 4D-4D in FIG. 4C;

-FIG. 5A is a top perspective view, FIG. 5B is a bottom perspective view, FIG. 5C is a top plan view, FIG. 5D is a bottom plan view, FIG. 5E is a cross-sectional view taken along the line 5E-5E in FIG. 5D, FIG. 5F is a cross-sectional view of a nozzle of the spray face, and FIG. 5G is a cross-sectional view of the nozzle of the spray face;

—FIG. 11A is a front view, and FIG. 11B is a top view;

-FIG. 13A shows an unbroken stream length, and FIG. 13B shows a streamlet width; -FIG. 14A shows an end of an unbroken stream length, FIG. 14B shows an uncounted segment, and FIG. 14C shows a range of core and unbroken stream lengths.

DETAILED DESCRIPTION

The present invention provides a plumbing fixture fitting having a spray mode with improved spray performance. In an exemplary embodiment, the plumbing fixture fitting is a faucet. However, one of ordinary skill in the art will appreciate that the plumbing fixture fitting could be a showerhead, a handheld shower, a body spray, a side spray, or any other plumbing fixture fitting.

Figure 1:
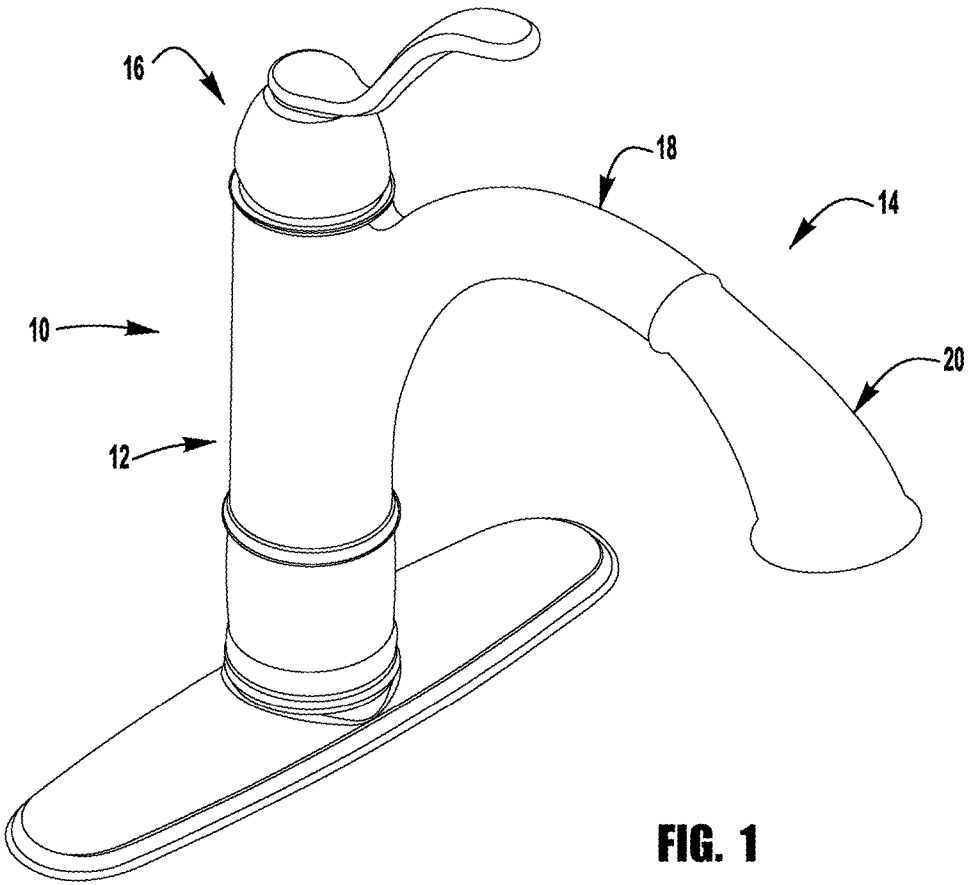
FIG. 1 is a perspective view of a faucet according to an exemplary embodiment of the present invention.

An exemplary embodiment of a faucet 10 of the present invention is shown in detail in FIG. 1. In the illustrated embodiment, the faucet 10 includes a hub 12, a spout 14, and a handle 16. The spout 14 includes a receptor 18 and a wand 20. A base of the hub 12 is connected (either directly or indirectly) to a mounting surface (such as a counter or sink). An upstream end of the receptor 18 is connected to the hub 12. In an exemplary embodiment, the upstream end of the receptor 18 is connected to a side of the hub 12. In an exemplary embodiment, the upstream end of the receptor 18 is connected to a top of the hub 12. An upstream end of the wand 20 is mounted in a downstream end of the receptor 18. The wand 20 is operable to pull away from the receptor 18. The wand 20 is operable to deliver water from the faucet 10. The handle 16 is connected to the hub 12. In an exemplary embodiment, the handle 16 is connected to the top of the hub 12. In an exemplary embodiment, the handle 16 is connected to a side of the hub 12. The handle 16 is operable to move relative to the hub 12.

Figure 2A:
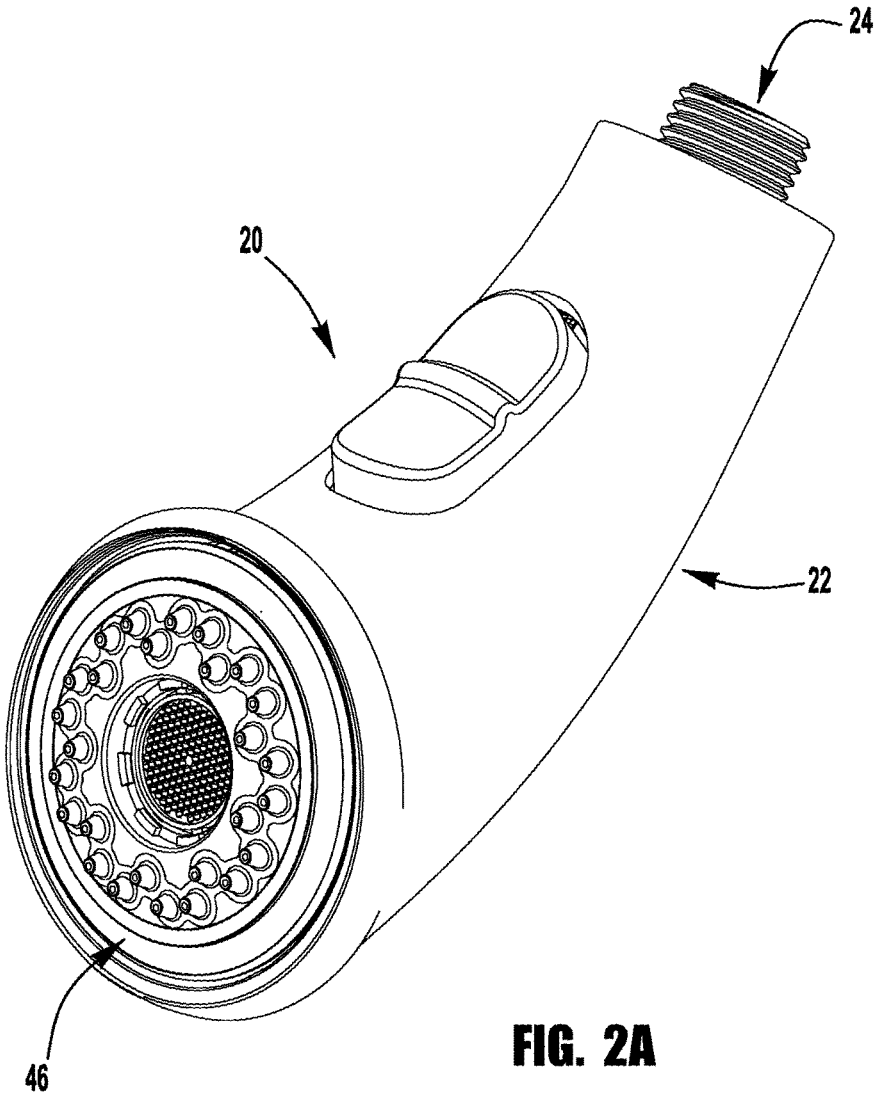
FIGS. 2A-2B are views of a wand for use in the faucet of FIG. 1
Figure 2B:
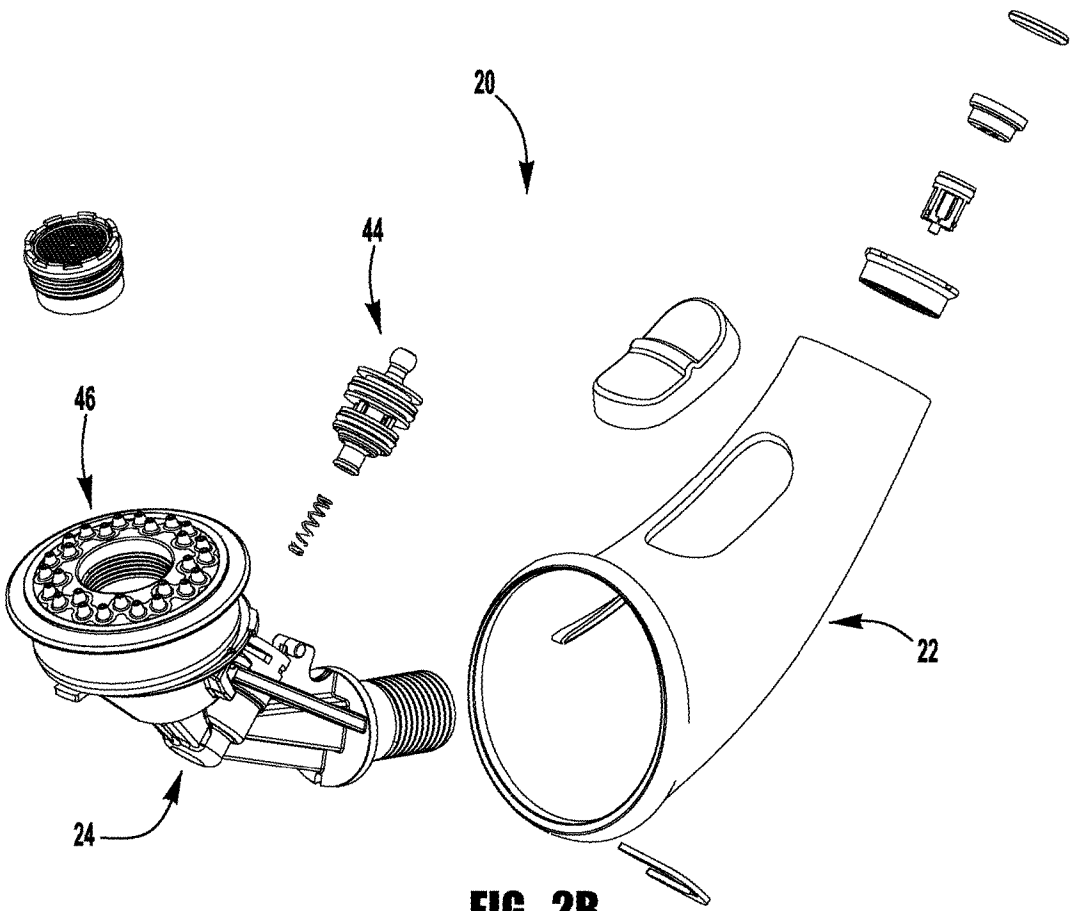
Figure 3A:
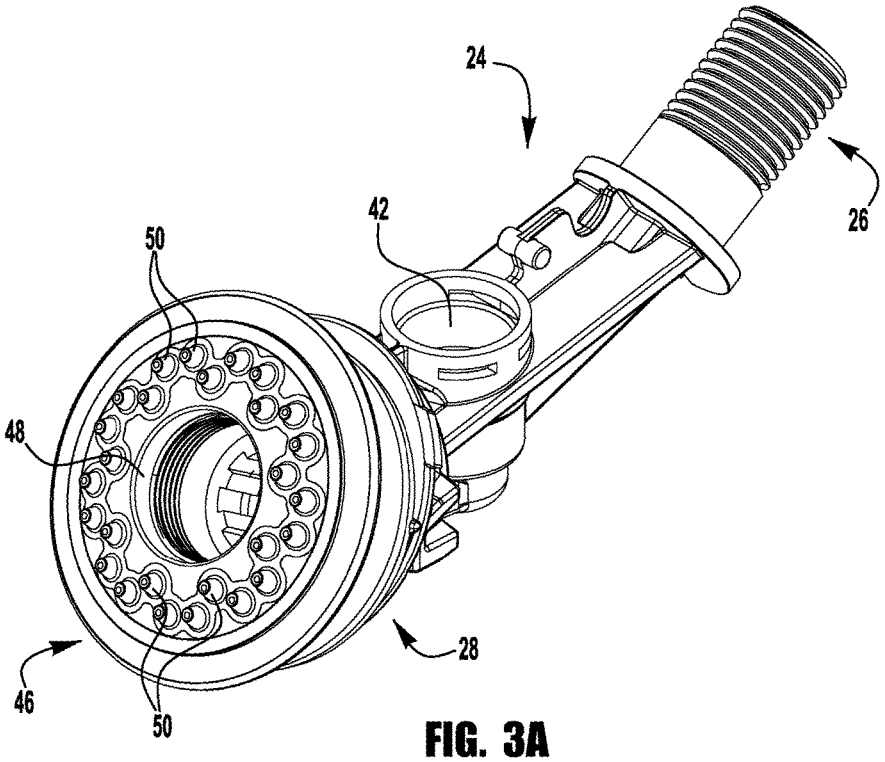
FIGS. 3A-3E are views of an assembled waterway and spray face for use in the faucet of FIG. 1
Figure 3B:
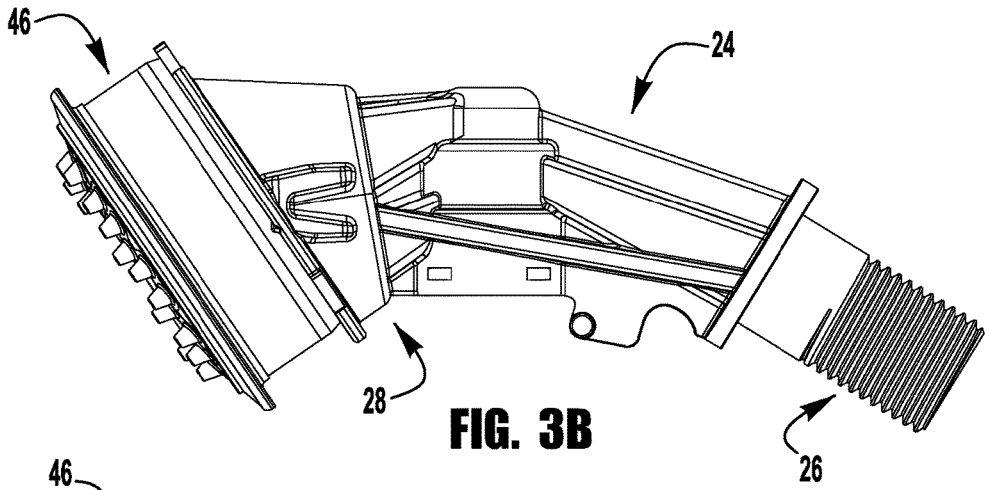
Figure 3C:
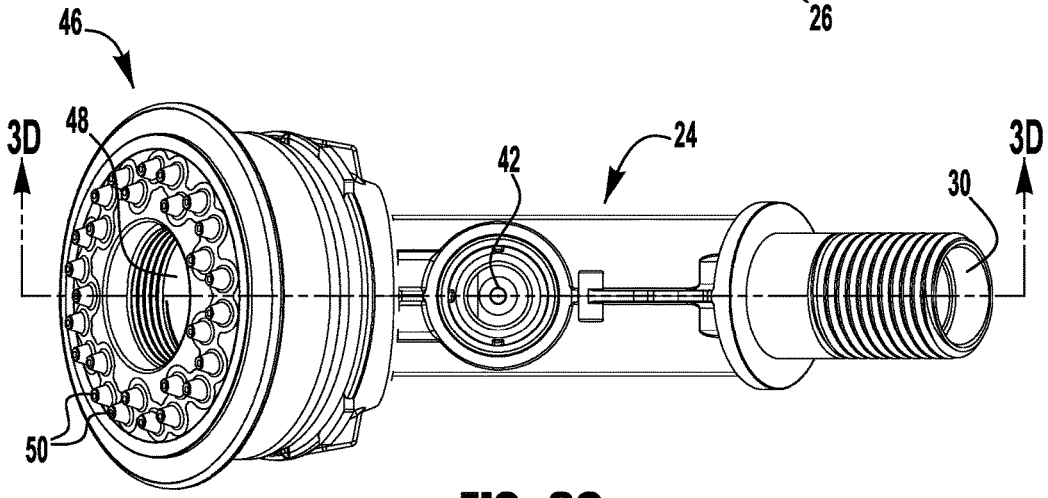
Figure 3D:
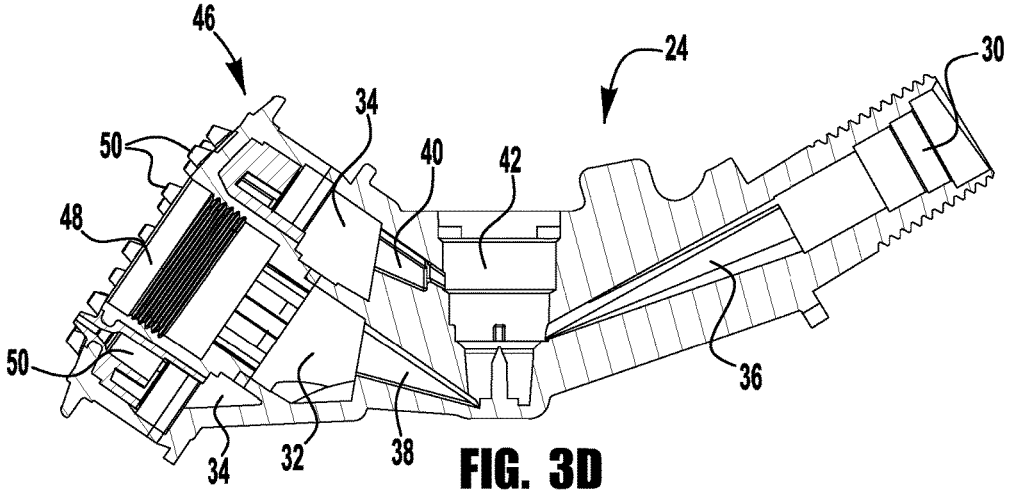
Figure 3E:
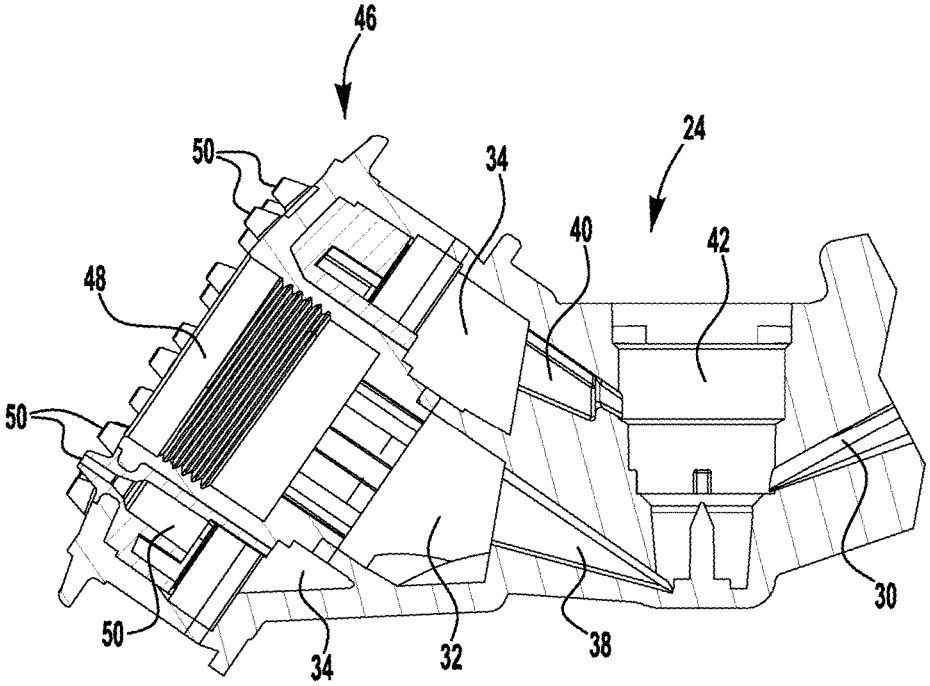
Figure 4A:
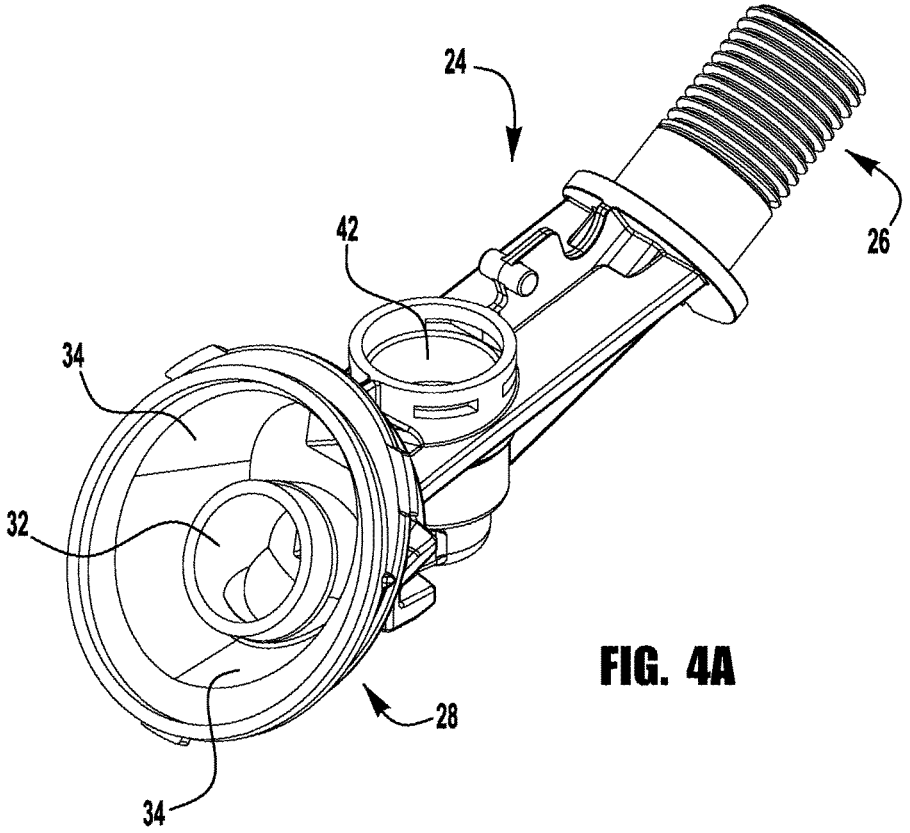
FIGS. 4A-4D are views of a waterway for use in the faucet of FIG. 1
Figure 4B:
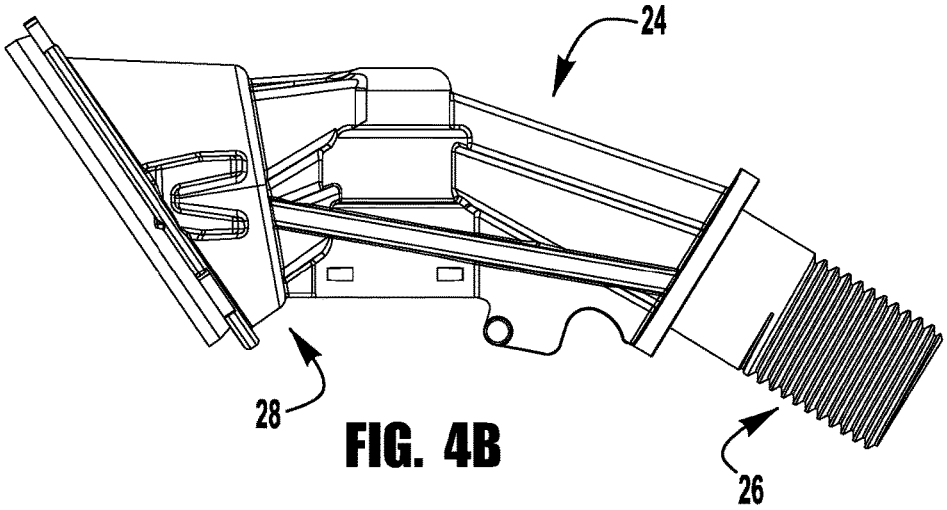
Figure 4C:
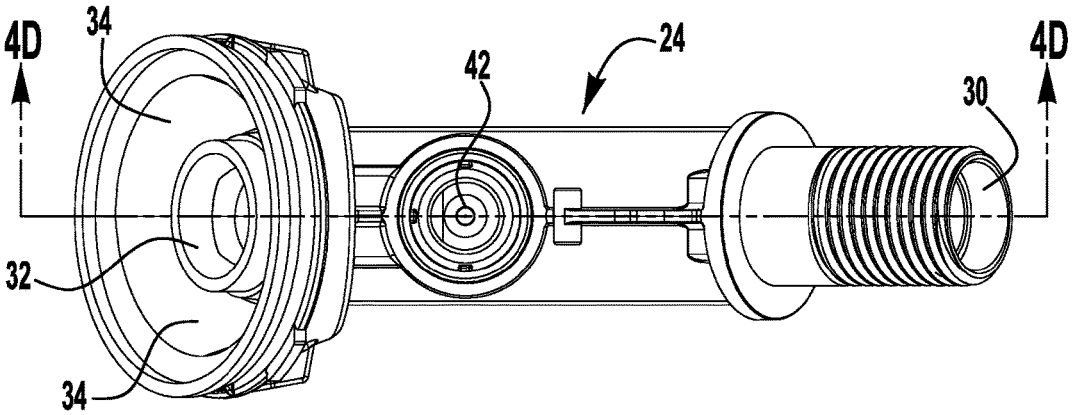
Figure 4D:
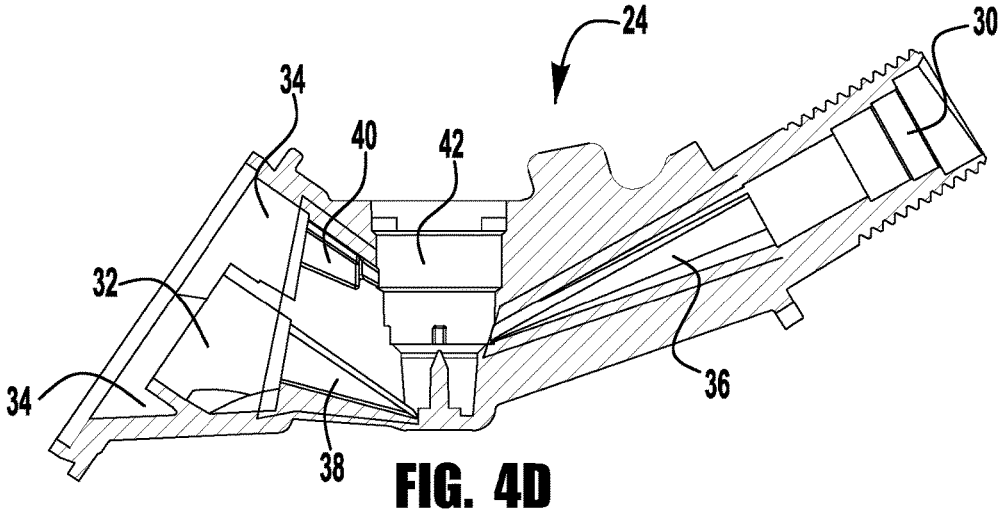

An exemplary embodiment of the wand is shown in detail in FIGS. 2A-2B. In the illustrated embodiment, the wand 20 includes a shell 22 and a waterway 24. The shell 22 is operable to pull away from the receptor 18. The waterway 24 is formed separately from the shell 22. The waterway 24 is substantially disposed within the shell 22.

An exemplary embodiment of the waterway 24 is shown in detail in FIGS. 3A-3E and 4A-4D. The waterway 24 includes an inlet region 26 and an outlet region 28. The inlet region 26 includes an inlet passage 30. The outlet region 28 includes a first outlet passage 32 and a second outlet passage 34. In an exemplary embodiment, the first outlet passage 32 is inside the second outlet passage 34. The inlet region 26 is connected to a water hose. The waterway 24 includes a first conduit 36, a second conduit 38, and a third conduit 40 disposed between the inlet passage 30 and the first outlet passage 32 and the second outlet passage 34. The waterway 24 includes a diverter valve chamber 42. The diverter valve chamber 42 is disposed between the first conduit 36 and the second conduit 38 and between the first conduit 36 and the third conduit 40.

Additionally, in the illustrated embodiment, the wand 20 includes a diverter valve 44. The diverter valve 44 is received in the diverter valve chamber 42. The diverter valve 44 diverts flow between the first conduit 36 and the second conduit 38 and between the first conduit 36 and the third conduit 40.

Further, in the illustrated embodiment, the wand 20 includes a spray face 46. The spray face 46 is connected to the outlet region 28 of the waterway 24.

An exemplary embodiment of the spray face 46 is shown in detail in FIGS. 3A-3E and 5A-5E. The spray face 46 includes an opening 48 and a plurality of nozzles 50. In an exemplary embodiment, the opening 48 is central and the nozzles 50 surround the opening 48. In an exemplary embodiment, the nozzles 50 are integrally formed with the spray face 46. The opening 48 fluidly communicates with the second conduit 38 and the first outlet passage 32 and delivers water from the spray face 46 in the form of a stream. The nozzles 50 fluidly communicate with the third conduit 40 and the second outlet passage 34 and deliver water from the spray face 46 in the form of a spray. The spray includes a plurality of streamlets.

Figure 5A:
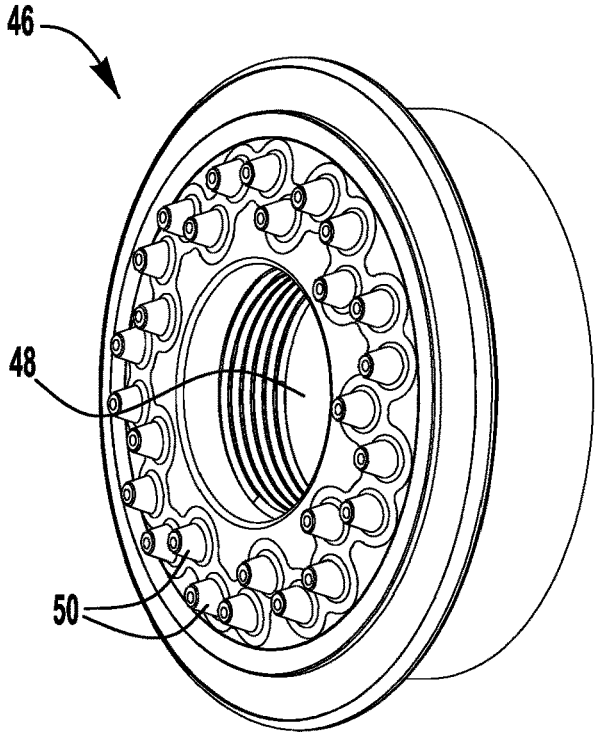
FIGS. 5A-5G are views of a spray face for use in the faucet of FIG. 1
Figure 5B:
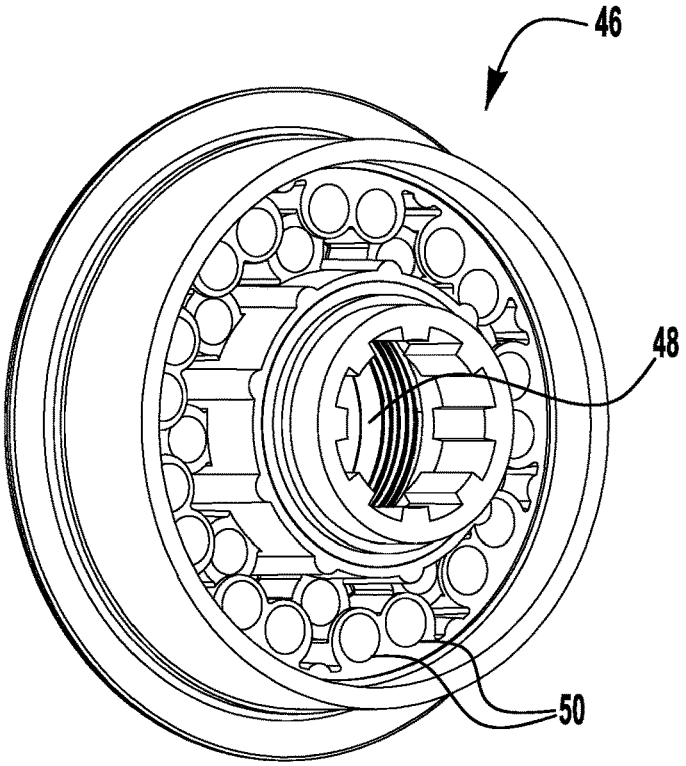
Figure 5C:
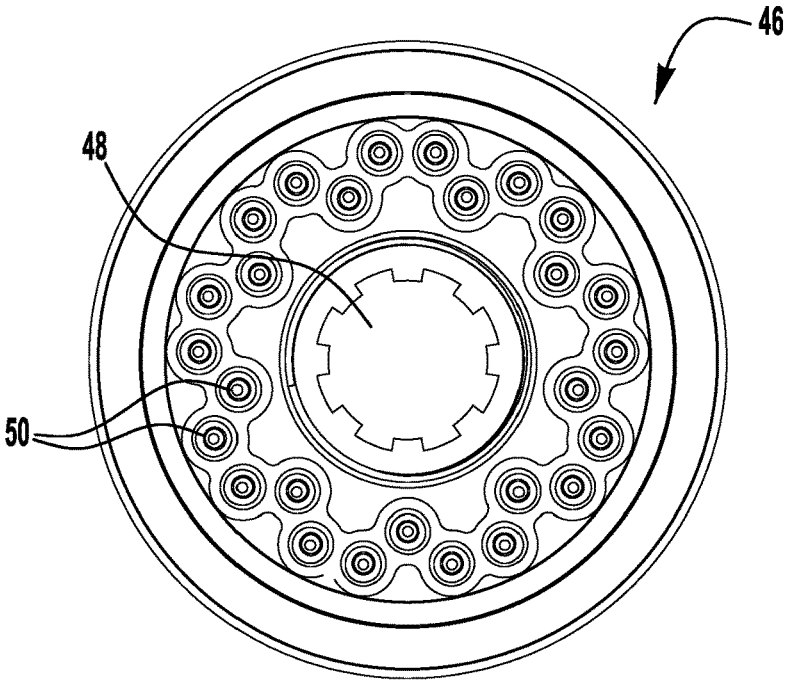
Figure 5D:
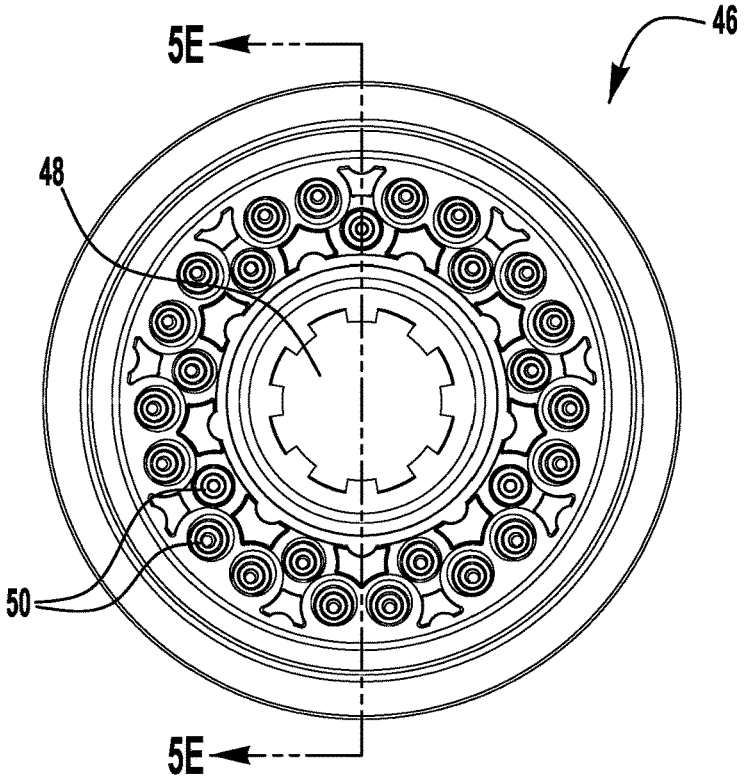
Figure 5E:
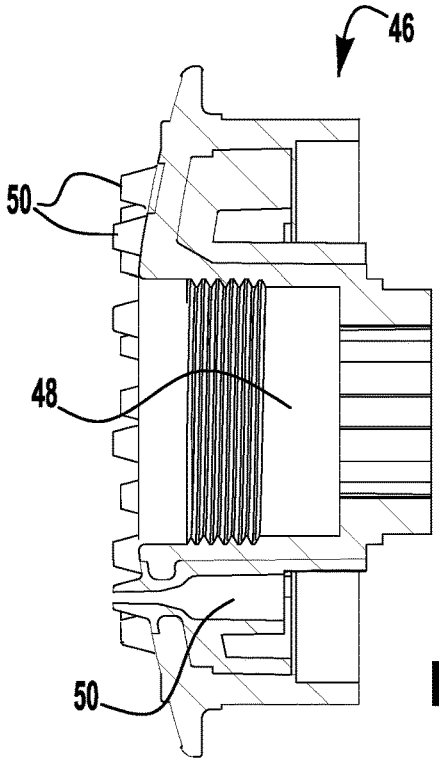
Figure 5F:
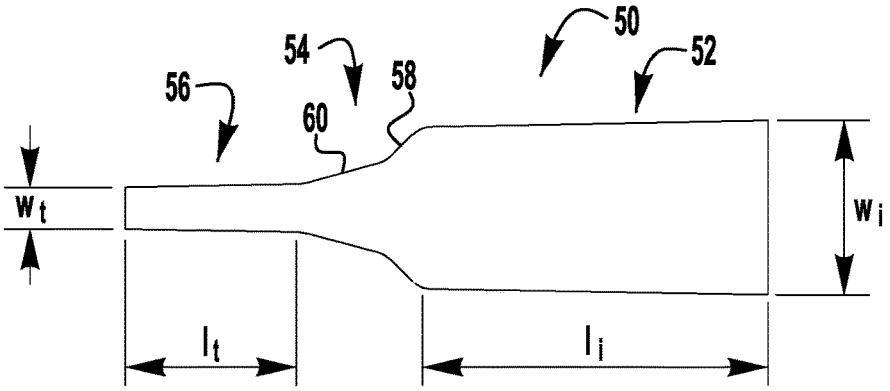
Figure 5G:
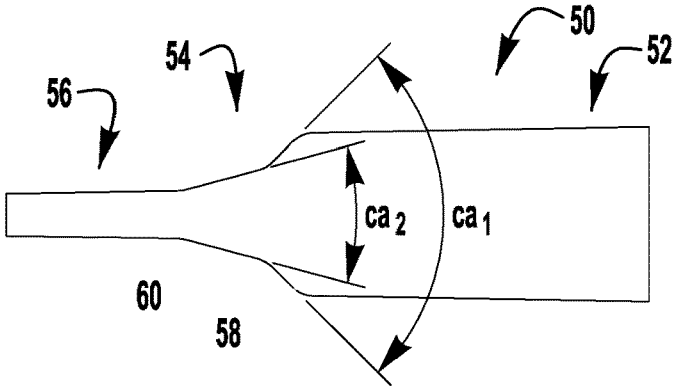

An exemplary embodiment of the nozzles 50 is shown in FIGS. 5F and 5G. At least one of the nozzles 50 includes an inlet section 52, a converging section 54, and a throat section 56. The inlet section 52 has an inlet width $w_i$ and an inlet length $l_i$. In an exemplary embodiment, the inlet section 52 is generally cylindrical shaped. The throat section 56 has a throat width $w_t$ a throat length $l_t$. In an exemplary embodiment, the throat section 56 is generally cylindrical shaped. The inlet width $w_i$ is greater than the throat width $w_t$. As used herein, a width of a component (such as the inlet section 52 or the throat section 56) is the dimension of the largest straight line segment extending from one point on the surface of the component to another point on the surface of the component in any plane that intersects the central longitudinal axis of the component at a right angle.

In an exemplary embodiment, the ratio of the inlet width $w_i$ to the throat width $w_t$ is greater than approximately one and a half (1.5). In another exemplary embodiment, the ratio of the inlet width $w_i$ to the throat width $w_t$ is greater than approximately two (2.0). In another exemplary embodiment, the ratio of the inlet width $w_i$ to the throat width $w_t$ is greater than approximately three (3.0).

In an exemplary embodiment, the ratio of the inlet length $l_i$ to the throat width $w_t$ is greater than approximately one-quarter (0.25). In another exemplary embodiment, the ratio of the inlet length $l_i$ to the throat width $w_t$ is greater than approximately one-half (0.5). In another exemplary embodiment, the ratio of the inlet length $l_i$ to the throat width $w_t$ is greater than approximately one (1.0).

In an exemplary embodiment, the ratio of the throat length $l_t$ to the throat width $w_t$ is greater than approximately one-quarter (0.25). In an exemplary embodiment, the ratio of the throat length $l_t$ to the throat width $w_t$ is greater than approximately one (1.0). In another exemplary embodiment, the ratio of the throat length $l_t$ to the throat width $w_t$ is greater than approximately two (2.0). In another exemplary embodiment, the ratio of the throat length $l_t$ to the throat width $w_t$ is greater than approximately three (3.0).

In an exemplary embodiment, the throat width $w_t$ is greater than approximately one hundredths of an inch (0.01 in) and less than approximately seven hundredths of an inch (0.07 in). In another exemplary embodiment, the throat width $w_t$ is greater than approximately two hundredths of an inch (0.02 in) and less than approximately five hundredths of an inch (0.05 in).

In the illustrated embodiment, the converging section 54 extends between the inlet section 52 and the throat section 56. The converging section 54 narrows from the inlet section 52 to the throat section 56. In an exemplary embodiment, the converging section 54 is generally conical shaped. In an exemplary embodiment, the converging section 54 is generally parabolic shaped. However, one of ordinary skill in the art will appreciate that the converging section 54 could have any shape that provides a generally smooth transition from the inlet section 52 to the throat section 56.

The converging section 54 has a convergence angle ca. As used herein, a convergence angle of a converging section 54 that is generally conical shaped is the included angle of the cone, and a convergence angle of a converging section 54 that is not generally conical shaped is the angle between tangents to opposing sides of the surface of the converging section 54 at the midpoint along the length of the converging section 54.

In an exemplary embodiment, the convergence angle ca is less than approximately one-hundred twenty degrees (120°). In another exemplary embodiment, the convergence angle ca is less than approximately sixty degrees (60°). In an exemplary embodiment, the convergence angle ca is less than approximately thirty degrees (30°). In another exemplary embodiment, the convergence angle is less than approximately fifteen degrees (15°).

In the illustrated embodiment, the converging section 54 has a first converging portion 58 and a second converging portion 60. The first converging portion 58 is adjacent the inlet section 52, and the second converging portion 60 is adjacent the throat section 56. The first converging portion 58 has a first convergence angle $ca_1$, and the second converging portion 60 has a second convergence angle $ca_2$. In an exemplary embodiment, the first convergence angle $ca_1$ is greater than the second convergence angle $ca_2$.

Figure 6:
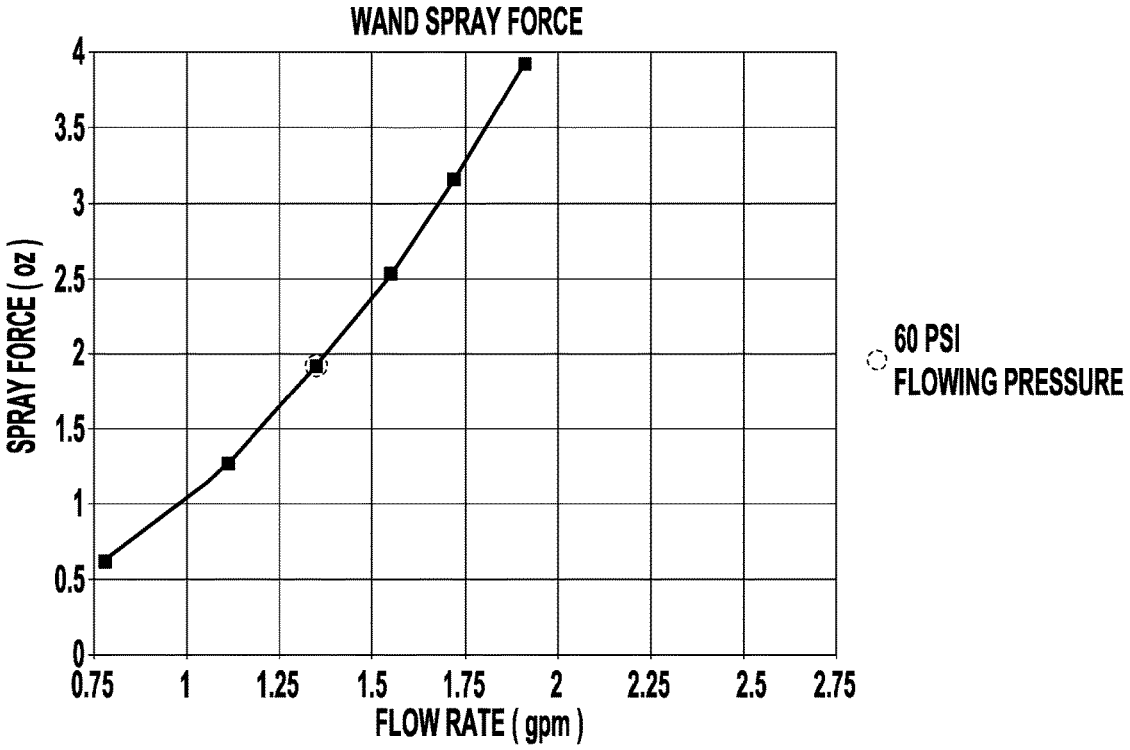
FIG. 6 is a graph showing a force of a spray delivered from the spray face of the wand of FIG. 2A.

In an exemplary embodiment, a force of the spray delivered from the spray face 46 is improved. FIG. 6 is a graph showing the force of the spray delivered from the spray face 46. The force was measured using a test procedure described in detail in Appendix A below. The test was conducted on the wand 20 of FIG. 2A.

In an exemplary embodiment, the force of the spray is greater than approximately two ounces (2 oz) at a flow rate of approximately one and a half gallons per minute (1.5 gpm). In another exemplary embodiment, the force of the spray is greater than approximately two and an eighth ounces (2.125 oz) at a flow rate of approximately one and a half gallons per minute (1.5 gpm). In another exemplary embodiment, the force of the spray is greater than approximately two and a quarter ounces (2.25 oz) at a flow rate of approximately one and a half gallons per minute (1.5 gpm).

Figure 7:
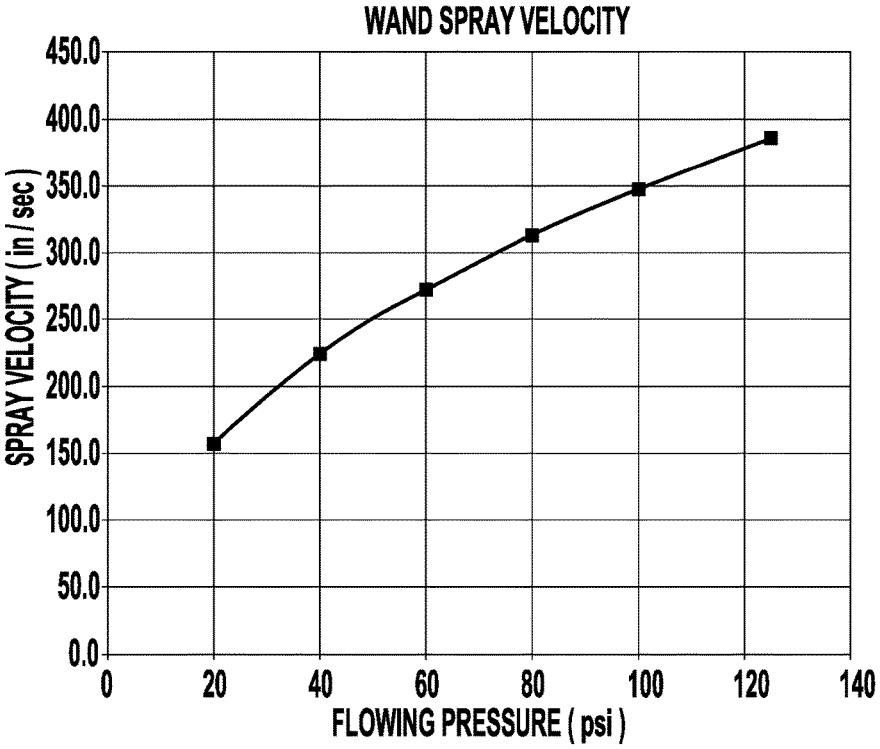
FIG. 7 is a graph showing a velocity of a spray delivered from the spray face of the wand of FIG. 2A.

In an exemplary embodiment, a velocity of the spray delivered from the spray face 46 is improved. FIG. 7 is a graph showing the velocity of the spray delivered from the spray face 46. The velocity was calculated using a flow rate, a number of nozzles 50, and a cross-sectional area of the throat section 56 of the nozzles 50. The flow rate was measured using a standard flow meter. The test was conducted on the wand 20 of FIG. 2A.

In an exemplary embodiment, the velocity of the spray is greater than approximately two-hundred fifty inches per second (250 in/sec) at a flowing pressure of approximately sixty pounds per square inch (60 psi). In another exemplary embodiment, the velocity of the spray is greater than approximately two-hundred sixty inches per second (260 in/sec) at a flowing pressure of approximately sixty pounds per square inch (60 psi). In another exemplary embodiment, the velocity of the spray is greater than approximately two-hundred seventy inches per second (270 in/sec) at a flowing pressure of approximately sixty pounds per square inch (60 psi).

Figure 8:
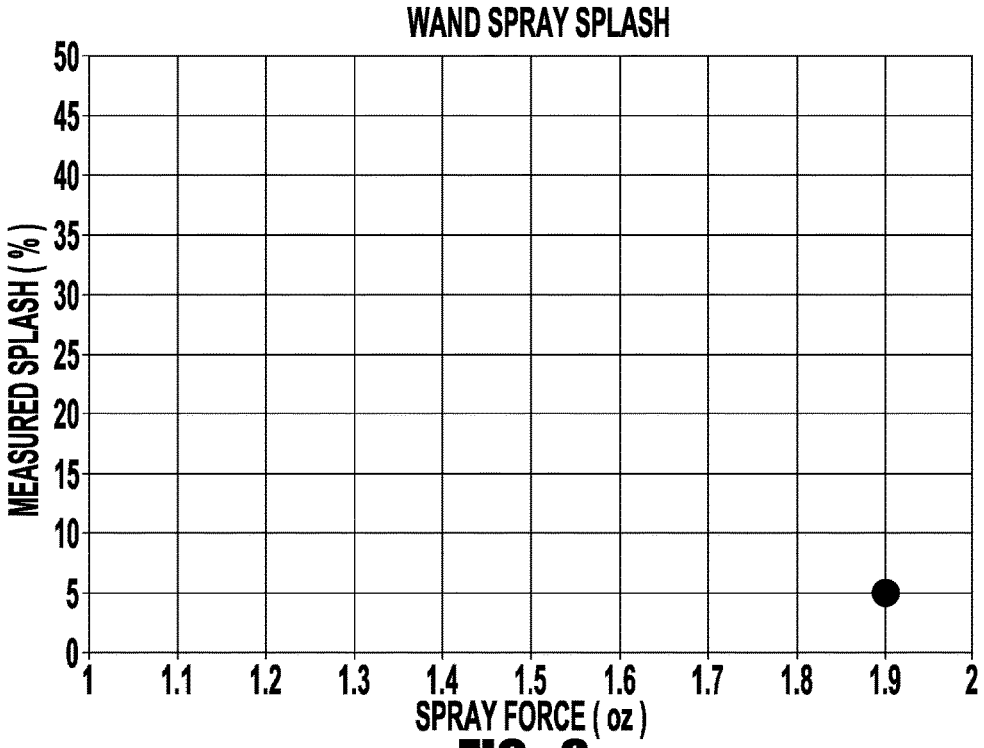
FIG. 8 is a graph showing a splash of a spray delivered from the spray face of the wand of FIG. 2A.

In an exemplary embodiment, a splash created from the spray delivered from the spray face 46 is improved. FIG. 8 is a graph showing the splash created from the spray delivered from the spray face 46. The splash was measured using a test procedure described in detail in Appendix B below and shown in FIGS. 11A-11B. The test was conducted on the wand 20 of FIG. 2A.

In an exemplary embodiment, the splash created from the spray is less than approximately twenty percent (20%) at approximately one and a half gallons per minute (1.5 gpm). In another exemplary embodiment, the splash created from the spray is less than approximately fifteen percent (15%) at approximately one and a half gallons per minute (1.5 gpm). In another exemplary embodiment, the splash created from the spray is less than approximately ten percent (10%) at approximately one and a half gallons per minute (1.5 gpm).

Figure 9:
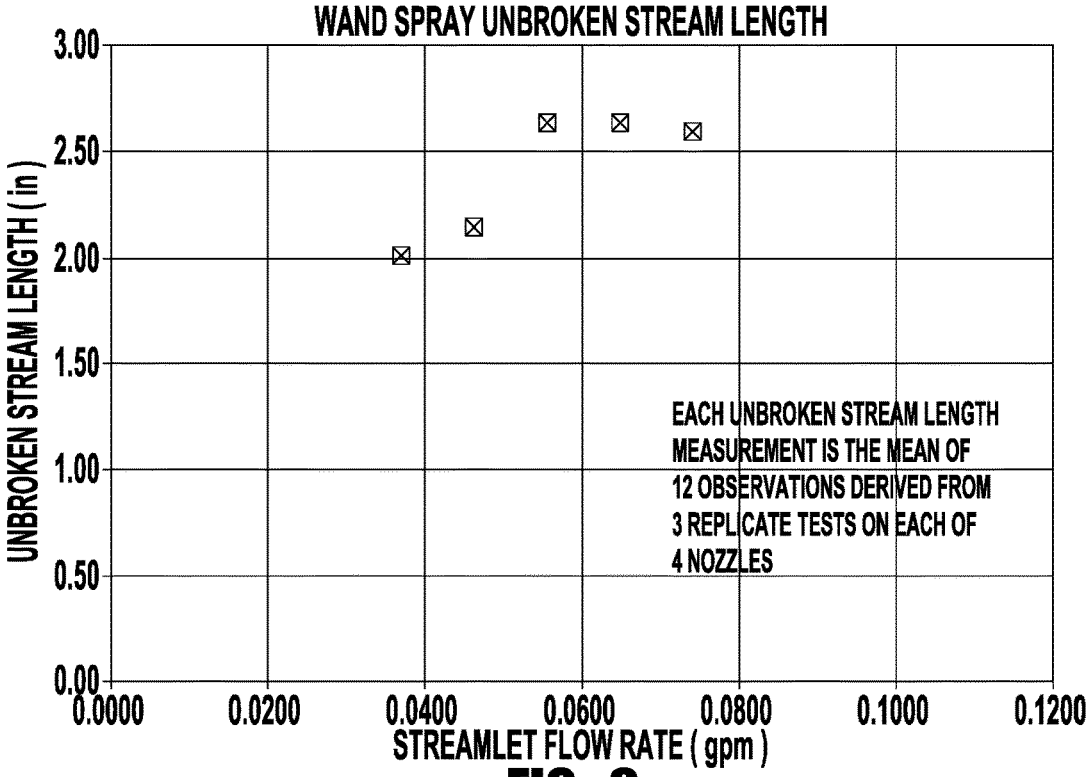
FIG. 9 is a graph showing an average unbroken stream length of a spray delivered from the spay face of the wand of FIG. 2A.
Figure 10:
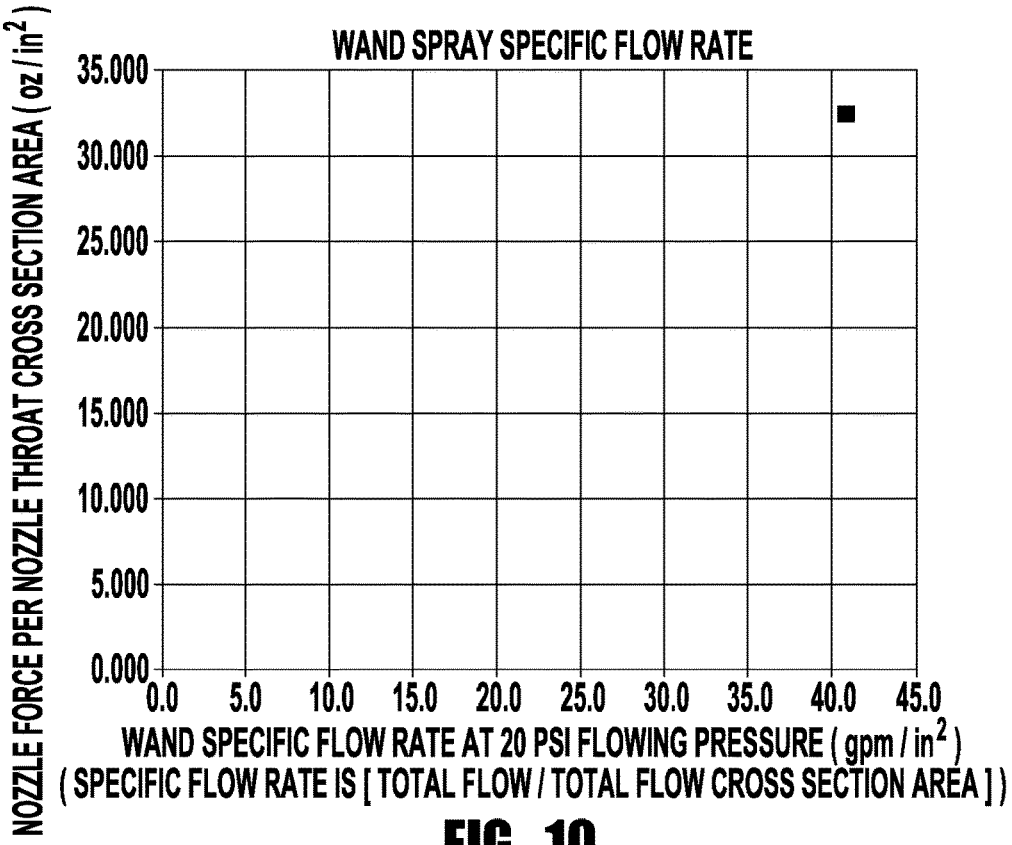
FIG. 10 is a graph showing a specific flow rate of a spray delivered from the spray face of the wand of FIG. 2A.

In an exemplary embodiment, an average unbroken stream length of the streamlets delivered from the spray face 46 is improved. FIG. 9 is a graph showing the average unbroken stream length of the streamlets delivered from the spray face 46. The average unbroken stream length was measured using a test procedure described in detail in Appendix C below and shown in FIGS. 12, 13A-13B, and 14A-14C. The test was conducted on the wand 20 of FIG. 2A.

In an exemplary embodiment, the average unbroken stream length of the streamlets is greater than approximately two inches (2 in) at a flow rate of approximately thirty-seven thousandths gallons per minute (0.037 gpm). In another exemplary embodiment, the average unbroken stream length of the streamlets is greater than approximately two and a quarter inches (2.25 in) at a flow rate of approximately thirty-seven thousandths gallons per minute (0.037 gpm). In another exemplary embodiment, the average unbroken stream length of the streamlets is greater than approximately two and a half inches (2.5 in) at a flow rate of approximately thirty-seven thousandths gallons per minute (0.037 gpm).

The present invention provides a plumbing fixture fitting having a spray mode with improved spray performance. An exemplary embodiment in which the plumbing fixture fitting is a faucet has been described and shown in detail. As stated above, one of ordinary will appreciate that the plumbing fixture fitting could be a showerhead, a handheld shower, a body spray, a side spray, or any other plumbing fixture fitting. These other exemplary embodiments include a waterway and a spray face. The waterway and the spray face of the other exemplary embodiments may differ in some aspects from the waterway 24 and the spray face 46 of the faucet 10. However, the waterway of the other exemplary embodiments includes an inlet region and an outlet region and passages and conduits for flowing water from the inlet region to the outlet region, and the spray face of the other exemplary embodiments includes nozzles for delivering water from the spray face in the form of a spray. At least one of the nozzles in the other exemplary embodiments includes the same structure as the nozzles 50 of the faucet 10.

Similarly, the structure for supporting and/or housing the waterway and spray face of the other exemplary embodiments may differ in some aspects from the structure for supporting and/or housing the waterway 24 and the spray face 46 of the faucet 10 (such as the hub 12 and the spout 14). For example, the structure for supporting and/or housing the waterway and the spray face of a showerhead may include a showerhead housing that is mounted to a wall and attached to a water supply via a shower pipe; the structure for supporting and/or housing the waterway and the spray face of a handheld shower may include a handheld shower housing that is mounted to a wall via any of a variety of mechanical mounting mechanisms and attached to a water supply via a water hose; the structure for supporting and/or housing the waterway and the spray face of a body spray may include a body spray housing that is mounted to or within a wall and attached to a water supply via a water pipe; the structure for supporting and/or housing the waterway and the spray face of a side spray may include a side spray housing that is mounted to a mounting surface via an escutcheon and attached to a water supply via a water hose.

Appendix A—Wand Spray Force Test Procedure

Spray wand is mounted in sink with plane of spray face oriented vertically. Circular flat rigid target plate 4.5" in diameter is mounted parallel to spray face at a distance 6" from spray face with center of circle at same height as center of wand spray face. Target plate is rigidly connected to a high sensitivity (100 inch pounds capacity) torque-type load cell via a 10" lever arm. (Spray target plate is rigidly mounted on cantilever supports. Cantilever supports for spray target are rigidly mounted to load cell.) Water is supplied to wand at temperature 100+/−5 deg F.+ and specified flowing pressure P1, P2, P3, etc up to about 125 psi. If necessary, height of wand is adjusted to ensure all jets from wand strike target plate. Flowing pressure, flow rate of water and force on target plate are recorded. (Note, technically, the raw load cell reading is a torque. Since the length of the lever arm is known, the corresponding applied force can be calculated.)

Appendix B—Wand Spray Splash Test Procedure

Customer Attribute: Spray that is focused and powerful but does not splash outside of the sink.

Figure 11A:
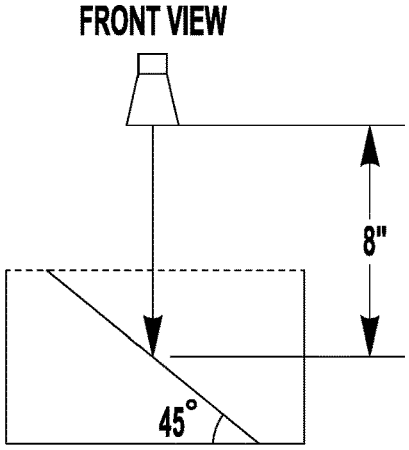
FIGS. 11A-11B are views of a test setup for a wand spray splash test procedure
Figure 11B:
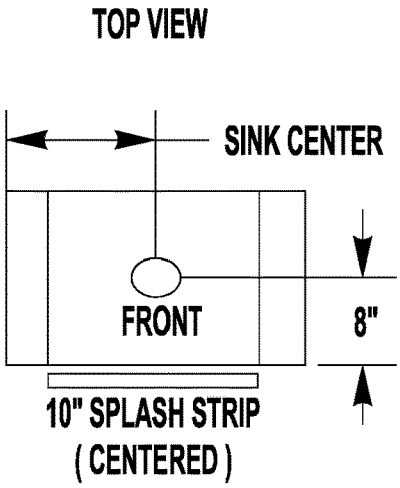

See FIGS. 11A-11B for test setup.

Test Methodology:

Splash Measurement Procedure: 1. Align 10 inch strip of water sensitive paper on front sink edge. Center strip with sink opening center. 2. Cover the strip to protect it from moisture. 3. Turn on sprayer with 60 psig static line pressure, cold water 50-60° F., hot water 130-140° F. 4. Mount the wand so that the spray face is aimed straight down and 8 inches away from 45 degree spray target. Spray face should be positioned 8 inches from sink front edge and center on sink opening. 5. Flow water through the faucet assembly at 60 psi static pressure using cold (ambient) and hot water (130-140 degrees F.). 6. Uncover the collector strip for 30 seconds. At the end of 30 seconds, turn water off. 7. Remove collector strip and analyze results.

Wand Spray Splash Analysis Procedure: 1. Find worst case 1 inch area along 10 inch strip (most splash (blue)). Take a photo or scan of this area. Create a 1 inch square with Snagit or any other screen capture program. 2. Open image in ImageJ or any other image processing and analysis program (ImageJ is available for download from the National Institutes of Health at: http://imagej.nih.gov/ij/download/). 3. Adjust recognition threshold (Image>Adjust>Threshold; set color space=RGB). Uncheck Blue "Pass" box. Adjust color ranges to fill in blue spots with red. 4. Draw a line across the width of the strip (known 1.0" distance). 5. Set scale (Analyze>set scale>set to known distance=1.0, Units=Inches, set Global). 6. Using rectangle tool, draw a 1 inch square at the area of interest. 7. Analyze>Analyze particles (set to Overlay masks, Display results, clear results, summarize>OK). 8. Distribution of blue (wet) sections listed as % Area. 9. Use the % Area value when calculating Normalized Spray Splash per Normalized Spray Force (Attribute #PAxxx).

Appendix C—Wand Spray Unbroken Stream Length Test Procedure

Streamlet—Droplet Progression: Past work identified that maintaining an unbroken streamlet length is key to cleaning effectiveness and reducing splash. Better Cleaning, Less Splash: Core Zone—Unbroken Stream; Generally smooth. Transition Zone—Ligaments Form; Thin-Thick waves form; Diameter increase+decrease. Less Power, Splashier: Droplet Formation—Ligaments Form; Surface tension pulls ligaments into droplets; Diameters grow and slow. Droplet Growth—Droplets continue to grow and slow; Aerodynamic forces fracture droplets into smaller sets.

Test Setup: A test set up was designed to independently control influencing variables.

Figure 12:
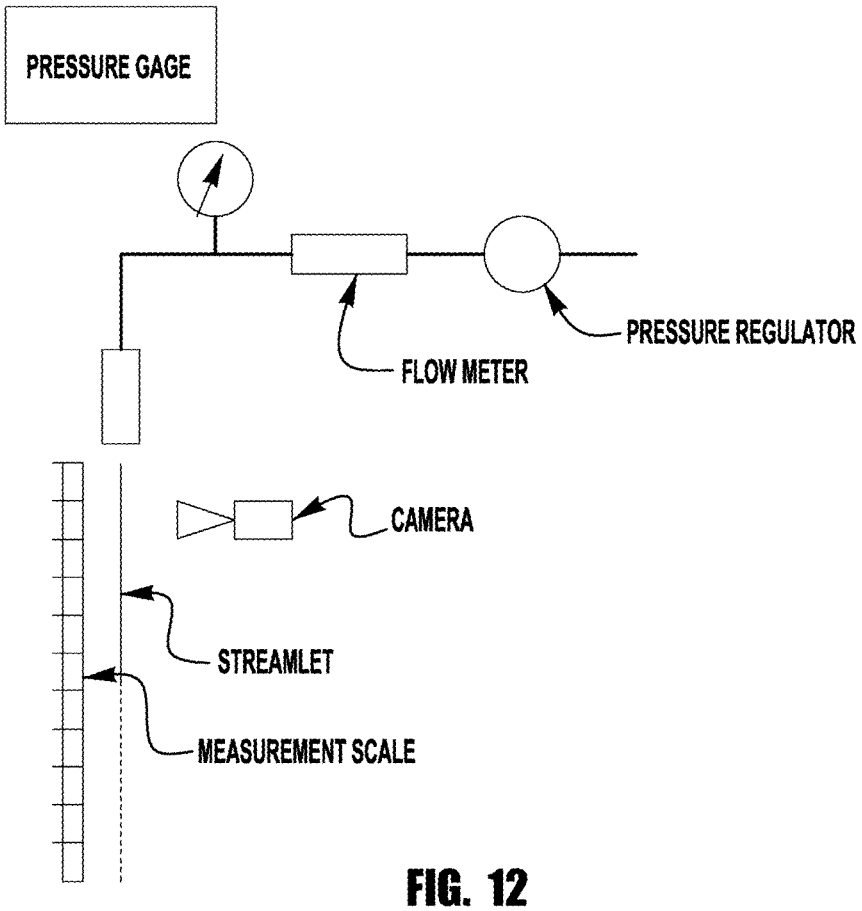
FIG. 12 is a view of a test setup for a wand spray unbroken stream length test procedure.
Figure 13A:
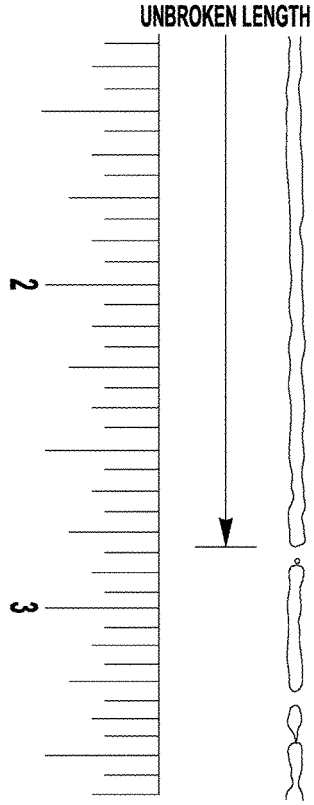
FIGS. 13A-13B are views of a streamlet
Figure 13B:
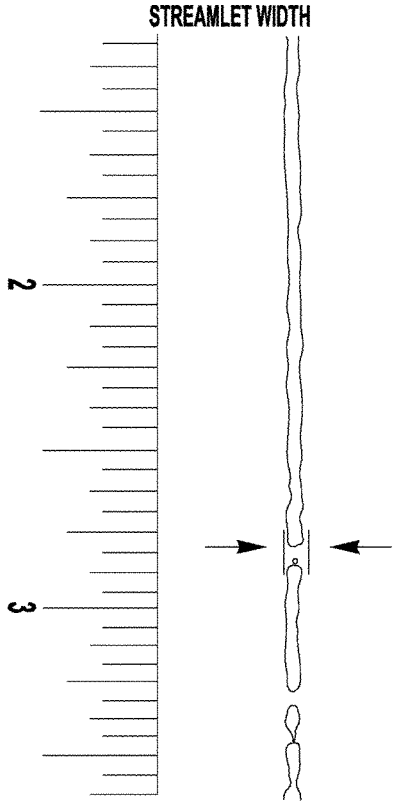
Figure 14C:
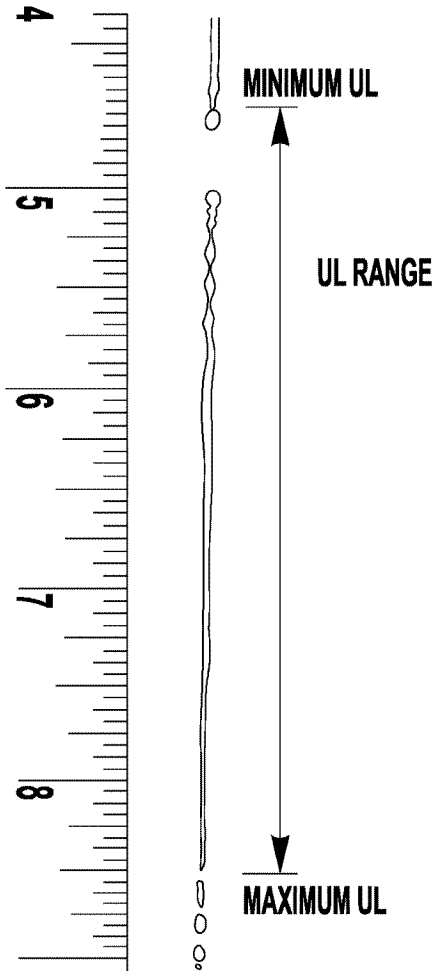
FIGS. 14A-14C are views of streamlets
Figure 14B:
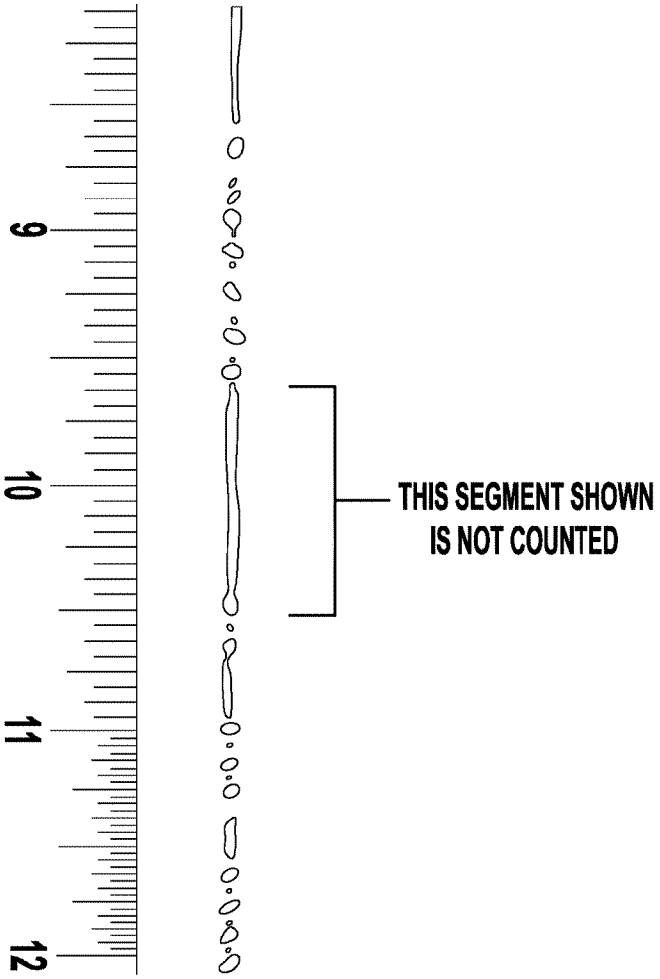
Figure 14A:
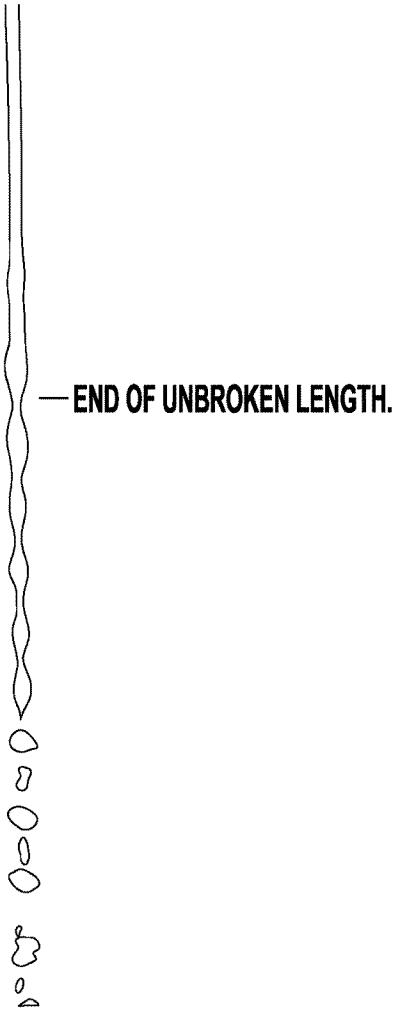

See FIG. 12 for test setup.

Measurement Method: Using a scale placed in plane with the Streamlet, the parameters were measured directly from a photograph. See FIG. 13A for Unbroken Length. See FIG. 13B for Streamlet Width. Length measurements are rounded to the nearest 0.1" increment. Using ImageJ software with digital zoom, 3-5 M-pixel camera resolution, 1/1000 sec. shutter speed, 400 ASA setting and side facing flash angle, while carefully accounting for parallax error, the method demonstrated 0.002" diameter repeatability and similar accuracy.

Test Procedure: 1. Effort was made at the beginning of each series to extract all upstream air from the line. The system was run at approximately 480 mL/min for several minutes. Hoses were shaken to allow air to work out through the flow. 2. Flow was reduced to target flowrate (typically 218 mL/min, streamlet flowrate for 2B cleaning spray) and allowed to flow 6 minutes before measuring data. 3. Most streamlets displayed a fast and irregular bimodal pulsation. Several photos were taken at the breakup region to attempt to capture min. and max. limits. However, test data scatter is expected due to the difficulty in capturing limits. 4. Except where specifically noted, test lab cold water was used and the temperature was generally in 60° F.-68° F. range. 5. Due to the somewhat subjective length measurement, UL accuracy is considered to be within 0.1".

Interpretation of Results: See FIG. 14A for End of Unbroken Length. For purposes of this test: Unbroken length is defined as the point where the neck is less than ½ the head of the forming droplet. See FIG. 14B for uncounted segment. A segment is counted into max unbroken length measurements only if it is longer than adjacent interrupted segments. The segment shown is not counted. See FIG. 14C for An example of Broad range of Core and Unbroken Lengths (16*a*), including Minimum UL, Maximum UL, and UL range.

One of ordinary skill in the art will now appreciate that the present invention provides a plumbing fixture fitting having a spray mode with improved spray performance. Although the present invention has been shown and described with reference to a particular embodiment, equivalent alterations and modifications will occur to those skilled in the art upon reading and understanding this specification. The present invention includes all such equivalent alterations and modifications.

What is claimed is:

1. A faucet, comprising:

a hub, the hub being operable to connect to a mounting surface; and a spout, the spout including a receptor and a wand, the receptor being operable to connect to the hub, the wand being operable to mount in the receptor, the wand being operable to pull away from the receptor;

the wand including a shell, a waterway, a diverter valve, and a spray face;

the shell being operable to pull away from the receptor;

the waterway being separately formed from the shell, the waterway being operable to be substantially disposed in the shell, the waterway including an inlet region and an outlet region, the inlet region including an inlet passage, the outlet region including a first outlet passage and a second outlet passage, the inlet region being operable to connect to a water hose, the waterway including a first conduit, a second conduit, and a third conduit disposed between the inlet passage and the first outlet passage and the second outlet passage, the waterway including a diverter valve chamber, the diverter valve chamber being disposed between the first conduit and the second conduit and between the first conduit and the third conduit;

the diverter valve being operable to be received in the diverter valve chamber, the diverter valve being operable to divert fluid flow between the first conduit and the second conduit and between the first conduit and the third conduit; and the spray face being operable to connect to the outlet region of the waterway, the spray face including an opening and a plurality of nozzles, the opening being operable to fluidly communicate with the second conduit and the first outlet passage and deliver water from the spray face in the form of a stream, the nozzles being operable to fluidly communicate with the third conduit and the second outlet passage and deliver water from the spray face in the form of a spray, the spray including a plurality of streamlets;

wherein an average unbroken length of the streamlets is greater than approximately two inches at a flow rate of approximately thirty-seven thousandths gallons per minute.

2. The faucet of claim 1, wherein the average unbroken length of the streamlets is greater than approximately two and a half inches at a flow rate of approximately thirty-seven thousandths gallons per minute.

3. The faucet of claim 1, wherein a force of the spray is greater than approximately two ounces at a flow rate of approximately one and a half gallons per minute.

4. The faucet of claim 3, wherein the force of the spray is greater than approximately two and a quarter ounces at a flow rate of approximately one and a half gallons per minutes.

5. The faucet of claim 1, wherein a velocity of the spray is greater than approximately two-hundred fifty inches per second at a flowing pressure of approximately sixty pounds per square inch.

6. The faucet of claim 5, wherein the velocity of the spray is greater than approximately two-hundred sixty inches per second at a flowing pressure of approximately sixty pounds per square inch.

7. The faucet of claim 6, wherein the velocity of the spray is greater than approximately two-hundred seventy inches per second at a flowing pressure of approximately sixty pounds per square inch.

8. The faucet of claim 1, wherein a splash created from the spray is less than approximately twenty percent at approximately one and a half gallons per minute.

9. The faucet of claim 8, wherein the splash created from the spray is less than approximately ten percent at approximately one and a half gallons per minute.

10. The faucet of claim 1, wherein each of the plurality of streamlets has a substantially uniform width along an entire length of the streamlet.

* * * * *